US006375256B1

(12) United States Patent
Rais

(10) Patent No.: US 6,375,256 B1
(45) Date of Patent: Apr. 23, 2002

(54) TABLE WITH SEATS THAT MOVE EN MASSE AROUND ITS PERIMETER

(76) Inventor: Paolo Rais, Via Riscina 8, 6925 Gentilino (CH)

( * ) Notice: Subject to any disclaimer, the term of this patent is extended or adjusted under 35 U.S.C. 154(b) by 0 days.

(21) Appl. No.: 09/486,397

(22) PCT Filed: Jul. 30, 1998

(86) PCT No.: PCT/IB98/01164

§ 371 Date: Feb. 28, 2000

§ 102(e) Date: Feb. 28, 2000

(87) PCT Pub. No.: WO99/11159

PCT Pub. Date: Mar. 11, 1999

(30) Foreign Application Priority Data

Aug. 28, 1997 (CH) ..... 2015/97

(51) Int. Cl.[7] ..... A47B 83/02

(52) U.S. Cl. ..... 297/157.1; 297/174; 297/232; 297/240; 297/241; 186/42; 186/49

(58) Field of Search ..... 297/157.1, 232, 297/240, 241, 174; 108/50.11, 64; 186/42, 49, 38

(56) References Cited

U.S. PATENT DOCUMENTS

| | | | | | |
|---|---|---|---|---|---|
| 746,615 | A | * | 12/1903 | Washburn | 186/42 |
| 1,389,656 | A | * | 9/1921 | Hall | 186/49 |
| 1,412,254 | A | * | 4/1922 | Meyer | 186/42 |
| 1,450,434 | A | * | 4/1923 | Doerfler | 186/49 |
| 1,846,532 | A | * | 2/1932 | De Kay | 186/49 |
| 1,881,898 | A | * | 10/1932 | Olson | 186/49 |
| 2,037,815 | A | * | 4/1936 | Ora | 186/49 |
| 2,640,581 | A | * | 6/1953 | Abitz | 186/49 X |
| 2,644,567 | A | * | 7/1953 | Springer | 186/49 X |
| 2,745,542 | A | * | 5/1956 | Boots | 186/49 X |
| 3,901,355 | A | * | 8/1975 | Shirashi | 186/49 X |
| 4,216,845 | A | * | 8/1980 | Tashman et al. | 186/49 |
| 4,765,440 | A | * | 8/1988 | Tashman | 186/49 X |

FOREIGN PATENT DOCUMENTS

| | | | | |
|---|---|---|---|---|
| FR | 2 362 604 | | 3/1978 | |
| GB | 619547 | * | 3/1949 | 186/42 |

* cited by examiner

*Primary Examiner*—Jose V. Chen
*Assistant Examiner*—Rodney B. White
(74) *Attorney, Agent, or Firm*—Young & Thompson

(57) ABSTRACT

A unit is described, consisting of an oblong table and a plurality of seats arranged approximately the same distance apart around the perimeter of the table. The unit includes elements designed to move the plurality of seats along en masse around the perimeter at a predetermined speed.

5 Claims, 4 Drawing Sheets

SECTION A - A

TABLE WITH SEATS THAT MOVE EN MASSE AROUND ITS PERIMETER

CROSS REFERENCE TO RELATED APPLICATION

This is the 35 USC 371 national stage application of International application PCT/IB98/01164 filed on Jul. 30, 1998 which designated the United States of America.

FIELD OF THE INVENTION

The present invention relates to the technological field of furniture, and more specifically to that sector involving the manufacture of tables for conferences, banquets or the like, together with associated seating for use by those taking part.

BACKGROUND OF THE INVENTION

The disadvantage of using a unit consisting of a table and seating constructed according to the current state of the art is that, especially in the case of banquets or conferences involving large numbers of people, it is only possible for participants to talk to and communicate with those people occupying the seats next to them or, at most, the seats very close to them.

What can happen, therefore, is that the entire banquet or conference can take place with some of the participants not having had the opportunity to meet and/or talk to all the other people seated at the same table. Such a state of affairs is hardly conducive to encouraging social contact and, in the case of work meetings, conferences, or other similar events, can limit the success of such meetings.

SUMMARY OF THE INVENTION

The inventor of the present invention has devised a unit consisting of a table and seats in which the seats are moved continuously at a limited, predetermined speed around the perimeter of the table, which has to be oblong so that, as the event progresses, a single participant will find himself sitting in front of different people and can, therefore, converse with, talk to or even simply meet all the other people sitting around the table.

More specifically, the subject of the present invention is a unit consisting of an oblong table and a plurality of seats arranged around its perimeter, characterized by the characterizing part of the appended claim 1.

A more detailed description of the unit according to the invention will now be given in connection with a preferred embodiment thereof which neither restricts nor limits any other embodiments that may be produced by putting the teachings of the appended claims into practice.

BRIEF DESCRIPTION OF THE DRAWINGS

In giving the said description, reference will also be made to the appended drawings, in which.

DETAILED DESCRIPTION OF THE INVENTION

Figure 1:
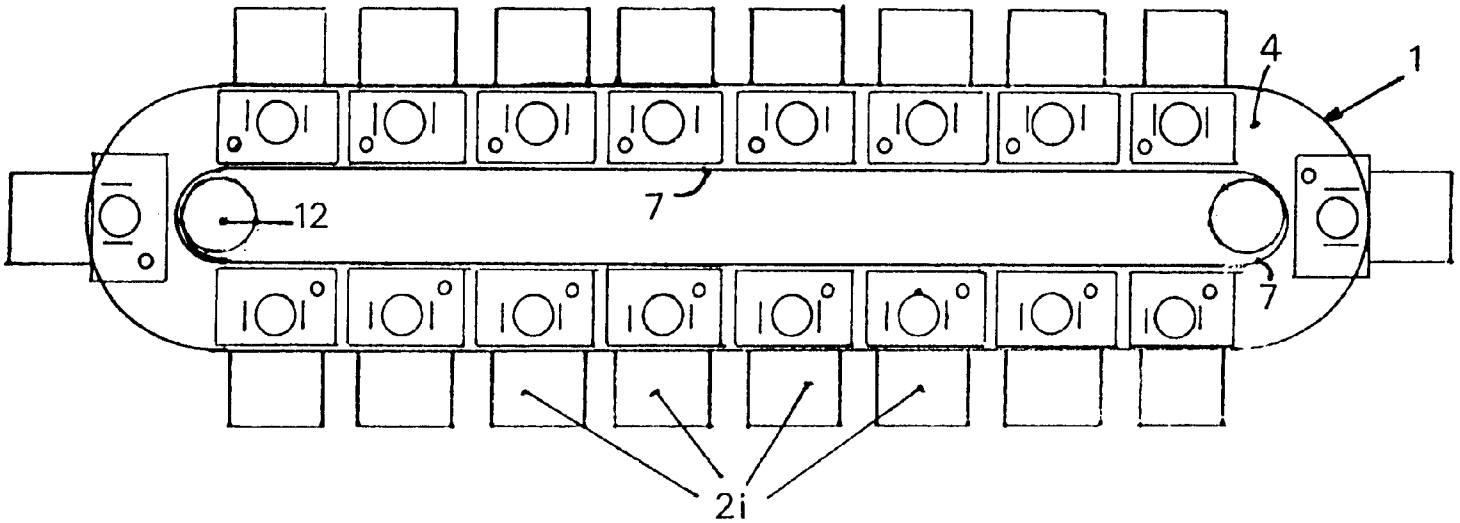
FIG. 1 is a plan view of the said embodiment of the unit according to the inventio.
Figure 2:
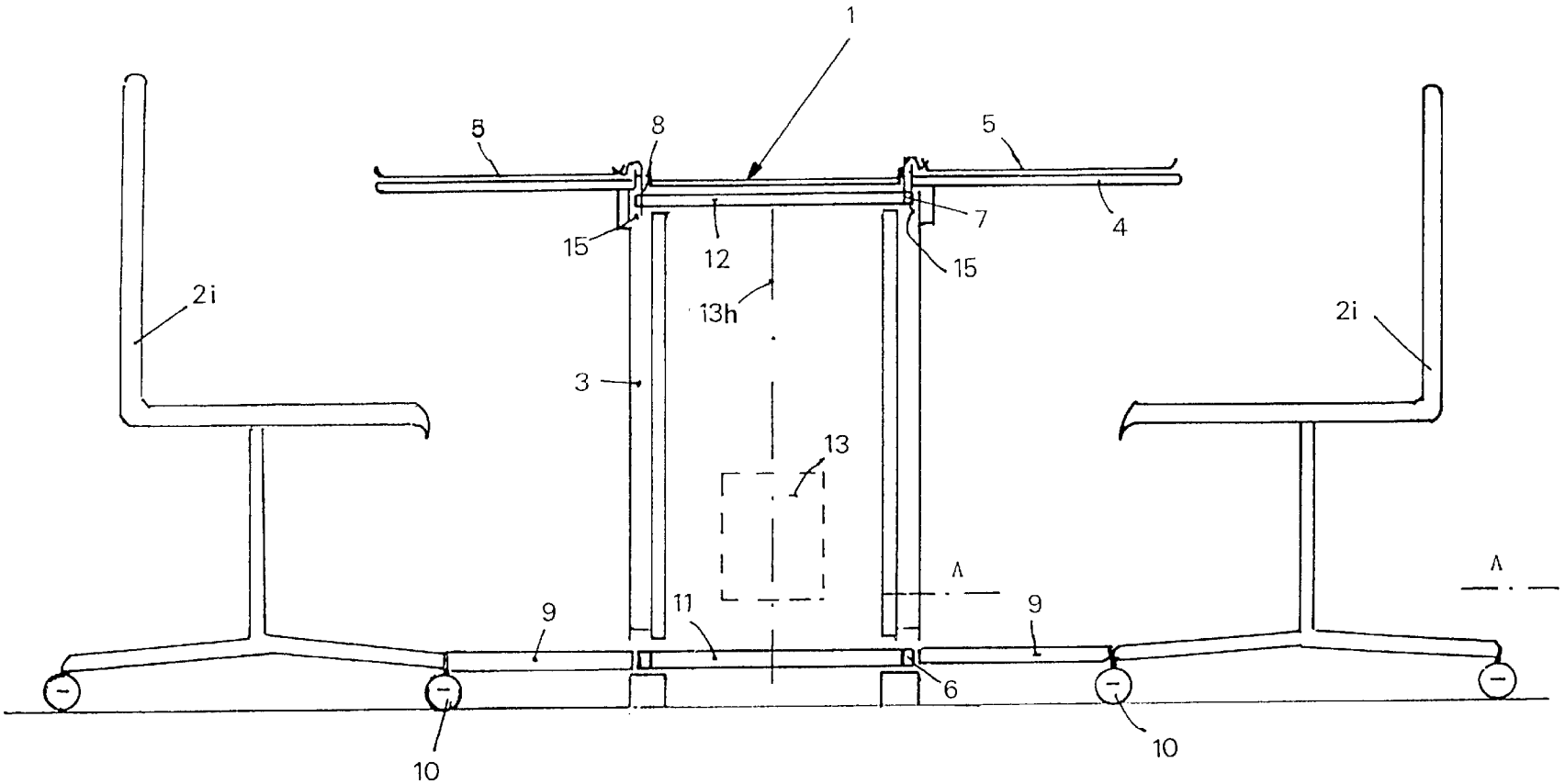
FIG. 2 is a cross-section thereof.
Figure 3:
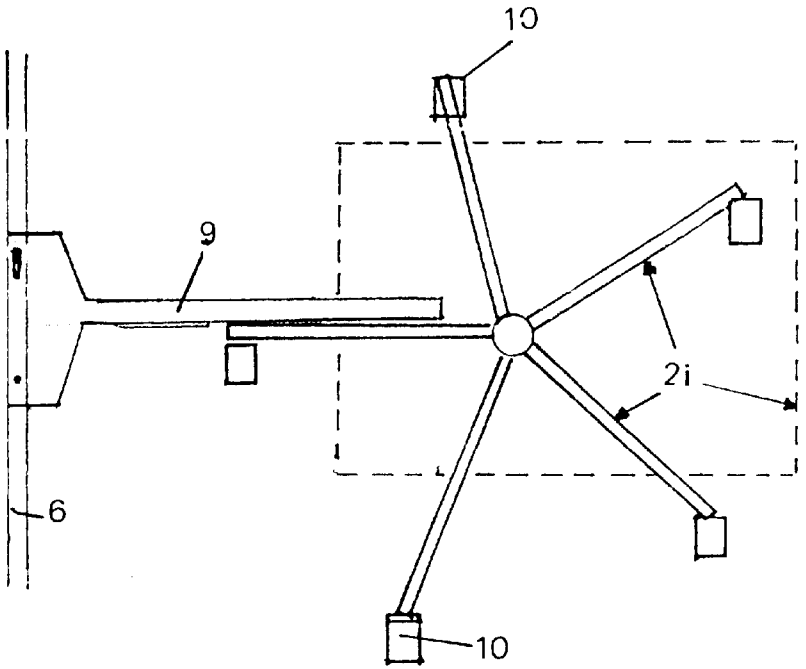
FIG. 3 is a partial horizontal longitudinal section thereof, limited to those areas showing the wheels of a seat and the points at which it is connected to the means which allow it to move around the perimeter of the table.

Looking first at FIGS. 1, 2 and 3, it may be seen that the table 1 of the unit according to the invention is first and foremost oblong in shape, in other words, not circular.

Moreover, the table need not necessarily have a straight longitudinal axis: for example, the table may also be in the shape of an arch, a horseshoe, a boomerang or some other shape, depending on requirements.

A number of seats, consisting in this example of chairs (**2*i*) mounted on castors 10, are arranged approximately the same distance apart around the perimeter of the table 1 which essentially consists of a central part, that acts as a support 3, and of a surface 4, positioned above the support, which projects a given distance out from it and runs around its entire perimeter, thereby defining the outer perimeter of the table 1**.

The number of chairs **2*i* that can be used depends on the length of the perimeter of the table 1, and this can be varied as desired, for example by inserting a variable number of adjacent modular elements designed to form either the said surface 4 or the said support 3**.

Needless to say, the dimensions of the members and equipment described below will also need to be altered accordingly.

The unit according to the invention is fitted with means designed to move all the said castor 10-mounted chairs **2*i* en masse and, in the example considered, these means consist of an electric motor 13 which is housed inside the support 3 and is connected by means of a shaft 13*h* (with only its axis denoted by dashed lines in FIG. 2) and a gear 11 to a drive chain 6—which will be referred to as the lower drive chain given its position close to the floor, this chain running around the entire perimeter of the support 3**.

This lower drive chain 6 is connected to one or more arms 9 of adjustable length so that the chair-to-table distance (see FIG. 3) can be adjusted for each chair **2*i*, these arms being connected to the chair, for example, close to the point at which the said respective castors 10** are attached.

As the electric motor 13 rotates it moves the lower drive chain 6 and the chair **2*i* connected to the latter is pulled along the perimeter of the table 1**.

The inventor suggests operating the electric motor 13 such that the set of chairs **2*i*** moves at an adjustable linear speed of between about 0.2 and 0.8 m/minute.

Given that, especially in the case of social gatherings, each chair **2*i* will have a corresponding cover arranged in front of it, it is of course essential for this cover to be able to move along at the same speed as to chair 2*i* with which it is associated. In order to achieve this the inventor envisages (see FIG. 4) keying an additional gear 12 onto the said shaft 13*h* of the electric motor 13, this gear 12 being positioned at the top end of the shaft, approximately at the same height as the said surface 4, and having an additional drive chain 7** attached to it.

This chain 7 is identical to the lower chain 6 described above and, given its position, will be referred to as the upper drive chain; its outer edge contains one or more recesses 14, located opposite each chair **2*i*, which are designated to contain an equivalent number of hooks 8 capable of pulling a tray 5 on which the corresponding cover has been laid and which is supported parallel to that part of the table 1 surface 4 that projects out from the said support 3**.

Figure 4:
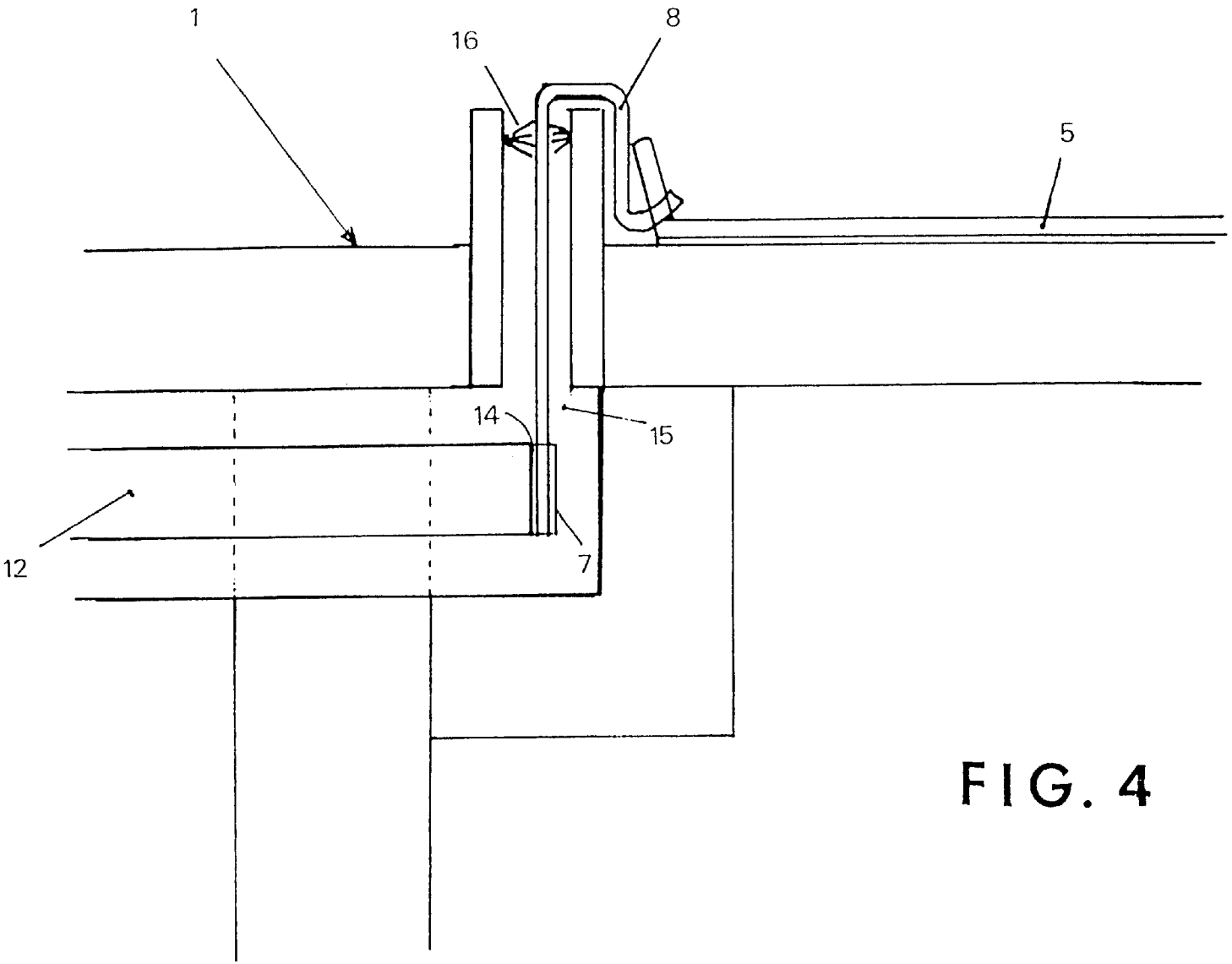
FIG. 4 is a cross-section of an area of the table relating to a tray, the latter also being connected to the means which allow the seats to move along as described.

The said hooks 8, as shown in FIGS. 2 and 4, are moved by the upper drive chain 7 along a cavity 15 formed around the perimeter of the table 1 in a position which separates the said projecting part of the surface 4 from the rest of the said surface. The said cavity 15 may be vertical, as shown in FIGS. 2 and 4, or also horizontal for a different disposition of the various parts.

It is advisable to attach a symmetrical double seal 16 along the entire length of the cavity 15, between the said cavity 15 and the hooks 8 that travel inside it, so as to catch objects of any kind, as well as dust, crumbs, etc.

Up to this point, only one pair of gears 11, 12 has been described, these being connected to the shaft 13*h* of the motor 13. However, in order for the present embodiment to work, it is of course necessary to install a second pair of gears (shown diagrammatically in FIG. 1) which may be idle or driven in a similar manner by a second electric motor and which would be located at the opposite end of the table 1 to that housing the motor 13 and the associated gears 11, 12.

This is necessary for the essential "deflection" of the two drive chains 6, 7, so that they can travel around the entire perimeter of the table 1.

The inventor has devised a simple and cost-effective embodiment which does not require any modification to existing floors, is easy to assemble and maintain and which possibly makes use of materials that are already commercially available, such as castor-mounted armchairs and trays. However, the embodiment described hitherto and illustrated in the drawings, as has already been said, is not the only one possible: for example, in order to move the seats 2*i* they could be mounted on a monorail which runs around the perimeter of the table 1, and/or the said seats 2*i* could be moved by means of more than one electric motor (one per seat or one for every n seats) which would be connected mechanically, by means of a rack system for example, to the said monorail. (This example has not been illustrated in the figures).

Moreover, a person skilled in the art would be able to carry out many other modifications to the unit, producing embodiments of the invention different to those examined hithereto but which would nevertheless be encompassed within the scope of protection offered by the present patent application if they were based on the appended claims.

Lastly, it is worth pointing out that, in addition to the advantages already described, a unit according to the present invention offers yet another, particularly significant, advantage when used in panoramic restaurants and similar premises: while sitting in his or her own chair 2*i*, each person at the table can enjoy panoramic views from various points within the 360 degrees of rotation, without having to rotate the entire floor of the premises, as has been the case hithereto in some of the more exclusive and original of existing restaurants.

What is claimed is:

1. A unit comprising:

an oblong table having a perimeter;

a plurality of seats arranged approximately the same distance apart around said perimeter;

means for moving said plurality of seats along en masse around said perimeter at a predetermined speed;

said table comprising a support and a surface positioned above the support;

said surface extending from and around said perimeter and having a part which projects a desired distance out from said support; and a plurality of trays with each tray positioned in front of each seat parallel to said surface, and operatively associated to said means for moving said plurality of seats such that each tray is carried along together with a corresponding seat facing such tray.

2. The unit according to claim 1, wherein the seats are castor-mounted chairs connected to a lower drive chain adapted to be located parallel to a floor and which extends around the entire perimeter of said support; said trays being connected to an upper drive chain which is identical to said lower drive chain and is located approximately level with said surface; said lower and upper drive chains being connected by gears to one or more electric drive motors located inside said support so that said lower and upper drive chains travel at the same speed.

3. The unit according to claim 2, wherein each tray is pulled along by one or more hooks reversibly inserted into an equivalent number of recesses formed along said upper drive chain; said hooks being moved by said upper drive chain through a cavity which separates that part of the surface that projects out from said support from the rest of the surface; a seal element being inserted between said cavity and said hooks along an entire length of said cavity.

4. The unit according to claim 3, wherein said castor-mounted chairs are connected to said lower drive chain by one or more straight connection elements having one end which is connected to said lower drive chain and another end which is connected to a castor-mounted chair.

5. The unit according to claim 2, wherein said castor-mounted chairs are connected to said lower drive chain by one or more straight connection elements having one end which is connected to said lower drive chain and another end which is connected to a castor-mounted chair.

* * * * *